US006439096B1

(12) United States Patent
Mungalov et al.

(10) Patent No.: US 6,439,096 B1
(45) Date of Patent: Aug. 27, 2002

(54) AUTOMATED 3-D BRAIDING MACHINE AND METHOD

(75) Inventors: Dmitri Mungalov, Raleigh; Alex Bogdanovich, Apex, both of NC (US)

(73) Assignee: 3TEX, Inc., Cary, NC (US)

( * ) Notice: Subject to any disclaimer, the term of this patent is extended or adjusted under 35 U.S.C. 154(b) by 0 days.

(21) Appl. No.: 09/724,565

(22) Filed: Nov. 28, 2000

(51) Int. Cl.[7] ..... D04C 3/06
(52) U.S. Cl. ..... 87/33; 87/50
(58) Field of Search ..... 87/33, 50

(56) References Cited

U.S. PATENT DOCUMENTS 3,894,470 A * 7/1975 Reichel ..... 87/24
4,096,781 A * 6/1978 Bock et al. ..... 87/28
4,989,644 A * 2/1991 Tanaka et al. ..... 139/116.2
5,067,525 A * 11/1991 Tsuzuki et al. ..... 87/33
5,388,498 A * 2/1995 Dent et al. ..... 87/50
5,501,133 A * 3/1996 Brookstein et al. ..... 87/33

FOREIGN PATENT DOCUMENTS

EP 0538481 A1 4/1993
JP 11100763 * 4/1999

* cited by examiner

*Primary Examiner*—Andy Falik
(74) *Attorney, Agent, or Firm*—Glasgow Law Firm, PLLC

(57) ABSTRACT

A machine for producing complex-shaped, three-dimensional engineered fiber preforms having unitary, integral and seamless structures and, a method for making the preforms on the machine, and preforms produced thereby. The integral design and structure of the preform is formed by a combination of interlacing and non-interlacing fiber systems that permits variable cross-sectional area and dimensions from a first end to a second end along an axis via selective activation and control of at least one module, preferably a plurality of moduli connected to each other in any desirable configuration.

23 Claims, 18 Drawing Sheets

AUTOMATED 3-D BRAIDING MACHINE AND METHOD

CROSS-REFERENCE TO RELATED APPLICATIONS

This non-provisional utility patent application contains related subject matter to one or more prior filed co-pending non-provisional applications although it does not claim priority therefrom; the following is a reference to each such prior application identifying the relationship of the applications and application Ser. No. 09/667951 for 3-D BRAIDED COMPOSITE VALVE STRUCTURE filed Sep. 22, 2000 to Bogdanovich, et al.

BACKGROUND OF THE INVENTION (1) Field of the Invention

The present invention relates generally to three-dimensional braiding technology, more particularly, to three-dimensional braiding machines and methods of manufacturing braided preform structures therewith.

(2) Description of the Prior Art

Braided textile structures have been manufactured by hand for many years. Also, it is known in the prior art to use machines for braiding and for the manufacture of braided preforms, perhaps even as early as 1770 when Mr. Bockmuhl built a braiding machine in Barmen. The 3-dimensional braiding process is a further improvement and substantial development over the 2-dimensional braiding of structures like "Litzen" and cordage. In 3-D braiding processes, the braiding yarn runs throughout the braided structure in all three dimensions. Thus, the structures of 3-D braids offer special properties, e.g., high torsion strength. Moreover, typically, it is known to use braided performs for composites and laminated structures for a variety of applications. Additionally, the use of high performance fibers for making multilayer preforms is known in the art.

The present invention is applicable to the design and manufacturing of a broad variety of cross-sectional shapes and dimensions of three-dimensional (3-D) braided fiber preforms and structures for a multiplicity of applications, including but not limited to preforms for making composite structures for aerospace and commercial aircraft, infrastructure, industrial and commercial components, and other applications. The design of machines for braiding has developed with the growing success and interest in high performance composite structures, in particular three-dimensional woven and braided preforms for use in composites, due to their high specific stiffness and strength, fatigue life, corrosion resistance, thermostability, and dimensional stability in a wide range of temperatures and agressive environments, Prior art machines have been limited in, most importantly, control, speed, dimension, and precision. More particularly, prior art machines have been unable to provide a density of yarn carriers that would permit the machine to make sufficiently large cross-sections for practical applications, much less a variety of cross-sectional shapes and their continuous variation along the braided part. By way of example, the 3-D rotational braiding machine manufactured by the company August Herzog employs a system that works with Geneva wheels, which is very similar to conventional braiding systems. This prior art braiding machine is based on the net-braiding machine, which allows the production of a net-braided structure through a systematically braided connection of small braids. Each Geneva wheel must be connected with the drive assembly and the brake mechanism which is necessary for the rotation and exact position of the Geneva wheel and the handing over process of the bobbins. Disadvantageously, the construction of the Geneva wheels requires a relatively high fell, or braiding point.

Also, disadvantageously, the machine dimensions affect the yarn compensation length. To balance the yarn compensation length, it is necessary to use an up-and-down wind balance system that can be controlled by a torsion arm. Hence, there are special problems using carbon and glass yarns, which are very sensitive to any torsion and redirections. Thus, there remains a need for a method and machine for that is sized and configured to work without space and control limitations and restrictions for yarn types that can work on machines of the prior art.

Additionally, it is known in the art to use a bobbin tip principle for 3-D braiding processes and machines. This type of system works without intersections, with smaller working place requirements and a special method of construction to minimize the yarn compensation length; also it is based on an interlacing or knocking process with only one yarn control system, with modified Geneva wheels that have two notches for working space in the third dimension, i.e., a bobbin can be configured in the working area of two Geneva wheels and can be controlled by them. However, the Geneva wheels have a defined curve that does not work with any intersection; this configuration only permits hemispherical arrangements and provides limited freedom of movement of the bobbins throughout the braided structure. Thus there remains a need for a method and machine that permits 3-D braiding of complex structures in a compact machine configuration.

Furthermore, machines of prior art could not produce wall-thickness sufficient to withstand further processing, much less provide adequate finished composite properties. Importantly, machines and methods of making braided fiber preforms according to the prior art have been unable to provide uninterrupted transition between components having different cross-sectional shapes and dimensions without making substantial changes to the machine configuration and/or yarn or fiber supply.

Thus, there remains a need for a machine and method for producing complex-shaped, three-dimensional engineered fiber preforms that may be used as mechanical components, more particularly, a complex shaped three-dimensional braided fiber preform formed and constructed of a unitary, integral construction including a plurality of fibers that are capable of producing a variety of cross-sectional shapes and sizes in a continuous series on a single machine.

SUMMARY OF THE INVENTION

The present invention is directed to a machine and method for producing complex shaped, three-dimensional engineered fiber preforms having unitary, integral and seamless structure and rigid composite structure made therefrom for use as a mechanical component, particularly for use as a T- and J-stiffener structures, I-beam structures, box-beam structures, tubular and circular cross-section beam structures, engine valves, and similar structures, and method for making the preform.

Preferably, a particular embodiment of the invention is a machine for forming 3-D braided structures having an integral design formed by selective combination of sets of straight yarns or fiber systems and interlacing continuous reinforcing yarns or fiber systems. The machine or device of a preferred embodiment according to the present invention includes the combined mechanical scheme for 3-D braiding, produces various types of axis-symmetric and non-symmetric braiding architectures, most particularly those having complex cross-sectional shapes, including, but not limited to rectangular-shaped structures, as well as cylindrical, conical, and radial yarn placement that can be used to make a variety of 3-D braided preforms, including but not limited to specific components like an integral engine valve with continuously variable reinforcement architecture at various zones of the valve.

Additionally, any of the various cross-sectional shapes may be manufactured on a single machine according to the present invention. The machine having at least one modular group (FIG. 3*c*) that includes two identical cells (FIG. 3*a*) and a gripping fork (2 in FIG. 3*b*) with its individual drive (6 in FIG. 3*b*) connecting the cells. Each cell consists of a horngear (1 in FIGS. 2*a,* 3*a*), drive shaft (8), gear (7), four carrier drivers (3 in FIGS. 2*b,* 3*a*), and at least two yam carriers or spindles (the case of four spindles is illustrated in FIG. 3*a*). Advantageously, the compact design of a horngear (FIG. 2*a*), carrier driver (FIG. 2*b*) and gripping fork (FIG. 2*c*) configurations enable to assemble any number of cells in machine module via innovative gate design (FIGS. 2*d* and 3*c*) for providing smooth transition of each of the at least two spindles from one cell to another. In addition to a minimum of two movable yarn carriers that are part of a cell, axial yarns can also be supplied through central holes in the horngear (shown in FIGS. 2*a,* 2*d*) from stationary bobbins placed outside the machine. A single machine module includes at least one modular group (FIGS. 2*d,* 3*c*) but is not limited to any particular number of modular groups.

The present invention is further directed to a method for making a complex shaped, three-dimensional engineered fiber preforms having a unitary, integral and seamless structure.

Accordingly, one aspect of the present invention is to provide a machine for automatically producing complex-shaped, three-dimensional engineered fiber preforms having unitary, integral and seamless structures for use in making rigid composite structure made therefrom for providing increased component stiffness, strength, durability, and stability.

Another aspect of the present invention is to provide a method for making complex-shaped, three-dimensional engineered fiber preforms having a unitary, integral and seamless structures on a single one-module machine that is scalable via adding modular groups to produce large dimensions and varied cross-sectional shapes.

Still another aspect of the present invention is complex-shaped, three-dimensional engineered fiber preforms having unitary, integral and seamless structures made on a single multi-modular machine that is scalable via adding modules or modular groups of cells to produce large dimensions and varied cross-sectional shapes.

Yet another aspect of the present invention is to provide a machine for making complex-shaped, three-dimensional engineered fiber preforms having unitary, integral and seamless structures made on a single multi-modular machine having a control system that permits selective activation and deactivation of modular groups such that changing the combination of activated modular groups changes the cross-sectional shape of the preform produced on the machine.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
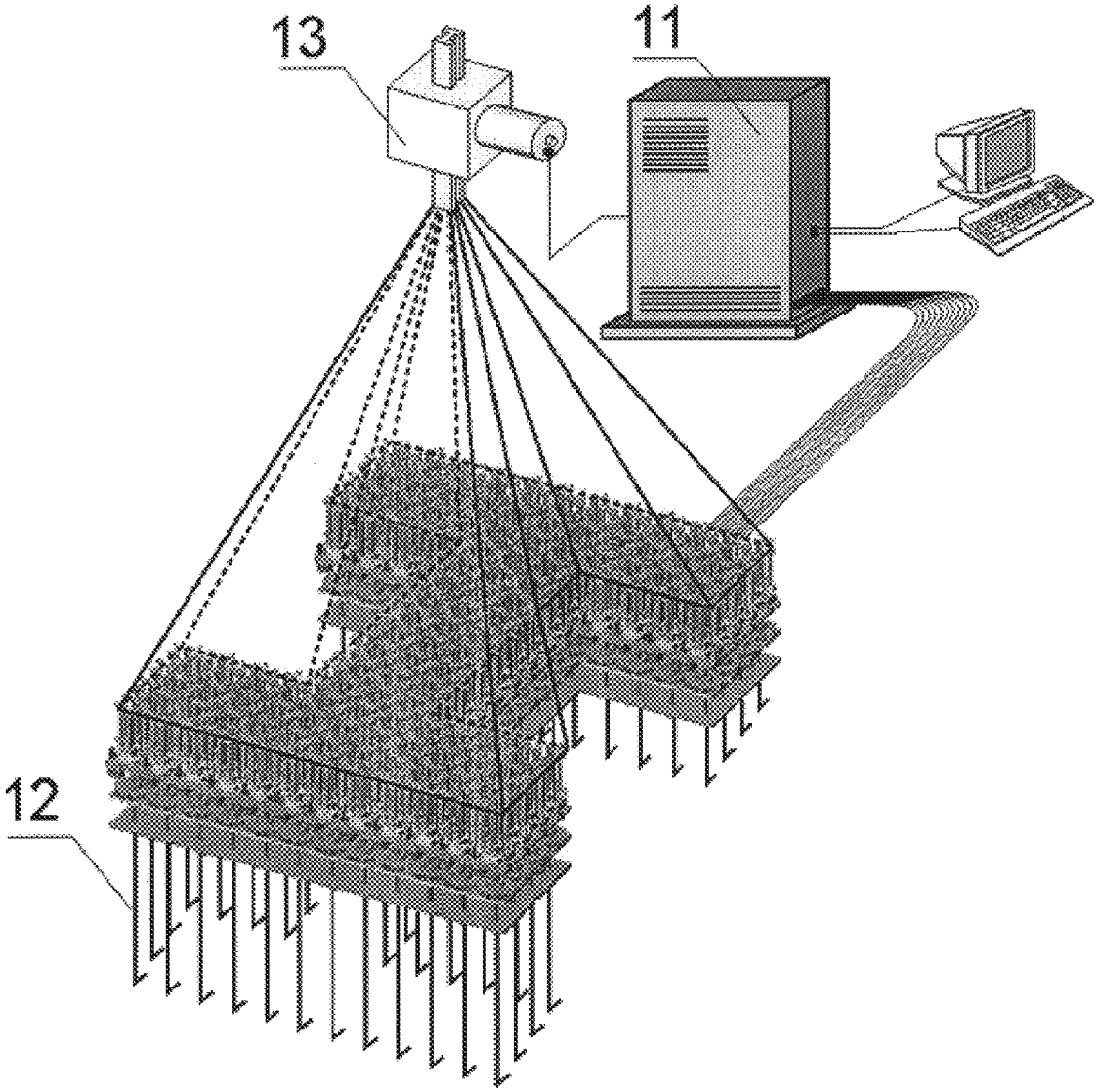
FIG. 1 illustrates a perspective diagram of a 3-D braiding machine constructed and configured according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. Referring now to the drawings in general, the illustrations are for the purpose of describing a preferred embodiment of the invention and are not intended to limit the invention thereto.

The present invention includes a machine for making complex shaped, threedimensional engineered fiber preforms in a variety of cross-sectional shapes and dimensions, the preforms having a unitary, integral and seamless structure and rigid composite structure made therefrom for providing increased component stiffness, strength, durability, and stability. As shown in FIG. 1, the machine includes at least one module of yarn supply cells or spindles in a compact horn gear configuration that are constructed and configured to move in a synchronized, predetermined pattern both selectively and simultaneously in circular trajectories within the at least one module. Note that where more than one module is connected and activated within the machine, each cell and any other cell has the capacity to traverse the distance of the connected moduli, crossing moduli borders in a smooth transition between moduli via a gate design shown in FIGS. 2 and 3 that removably attaches noduli at adjacent borders. FIG. 1 shows the overall illustration of the automated braiding machine according to the present invention for producing complex-shaped 3-D braided fiber preforms having variable and a variety of cross-sections and dimensions and produced in continuous series. The machine includes a supply of axial fibers 12, the take-up mechanism of removing a finished preform article 13, and the control system 11.

Referring now to FIGS. 2*a–d* and FIGS. 3*a–c,* the machine according to the present invention has at least one modular group as shown in FIG. 3*c* that includes two identical cells (FIG. 3*a*) and a gripping fork (2 in FIG. 3*b*) with its individual drive (6 in FIG. 3*b*) connecting the cells. Each cell consists of a horngear (1 in FIGS. 2*a,* 3*a*), drive shaft (8), gear (7), four carrier drivers (3 in FIGS. 2*b,* 3*a*), and at least two yarn carriers or spindles (the case of four spindles is illustrated in FIG. 3*a*). Advantageously, the compact design of a horngear (FIG. 2*a*), carrier driver (FIG. 2*b*) and gripping fork (FIG. 2*c*) configurations enable to assemble any number of cells in machine module via innovative gate design (FIGS. 2*d* and 3*c*) for providing smooth transition of each of the at least two spindles from one cell to another. In addition to a minimum of two movable yarn carriers that are part of a cell, axial yarns can also be supplied through central holes in the horngears (shown in FIGS. 2*a,* 2*d*) from stationary bobbins placed outside the machine. A single machine module includes at least one modular group (FIGS. 2*d,* 3*c*) but is not limited to any particular number of modular groups.

Figure 2:
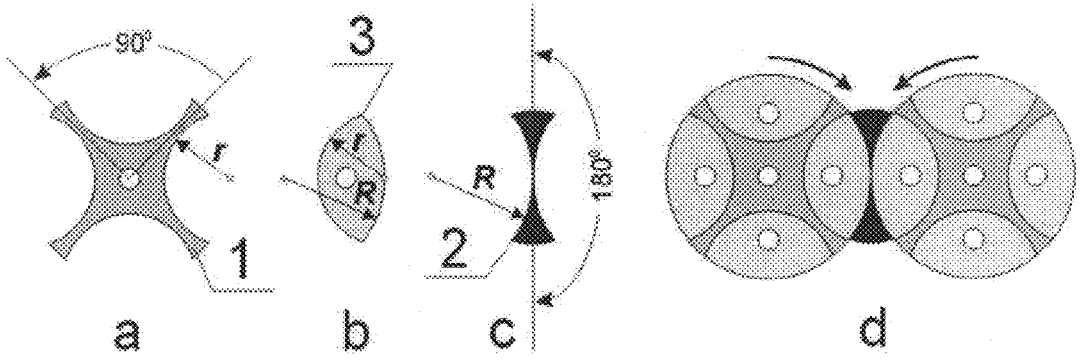
FIGS. 2*a–d* illustrate the shape and motion of components of a 3-D braiding machine constructed and configured according to the present invention.

Schematic of the basic elements is shown in FIG. 2. This includes the following important mechanical components of the machine: a horngear 1, a rotary gripping fork or gripping fork 2, and the carrier drivers 3, and a cell with adjoined four gripping forks. The carrier driver 3 has two cylindrical surfaces with various radiuses, R and r. A standard spindle is installed on the carrier driver 3. Radius R is equal to the external radius of the horn gear 1, while radius r is the radius of the horn gear cell 1. Further explanation of these notations is given in FIG. 2. Such form of the horngear cells 1 and the carrier drivers 3 makes it possible for the horngears 1 to move the carrier drivers 3 along the circle and to interchange the carrier drivers of the adjacent horngear cells. The special rotary gripping fork 2 is used to interchange carrier drivers 3. The gripping fork 2 has the capture elements with two adjoining cylindrical surfaces, each of radius R. The surfaces allow the carrier drivers 3 of any two adjacent horngears to move along the circular trajectories.

Figure 3:
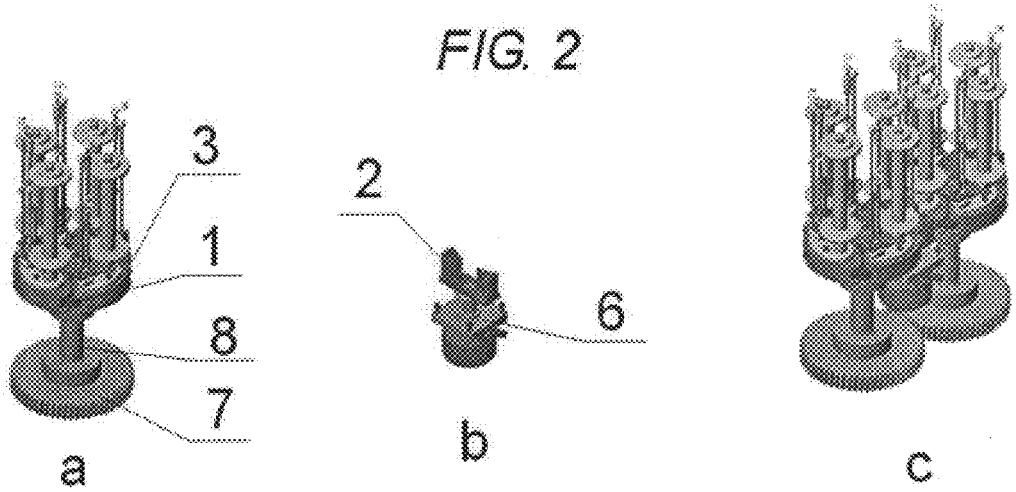
FIGS. 3*a–c* illustrate a perspective view of a cell (a), gripping fork with individual drive (b), and a modular group (c).
Figure 4:
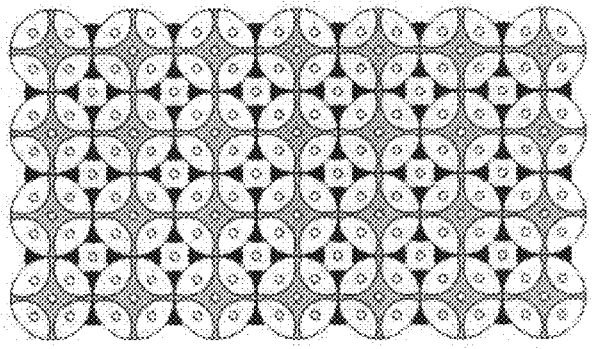
FIG. 4 illustrates a top view of a grouping of components of FIG. 3.
Figure 5:
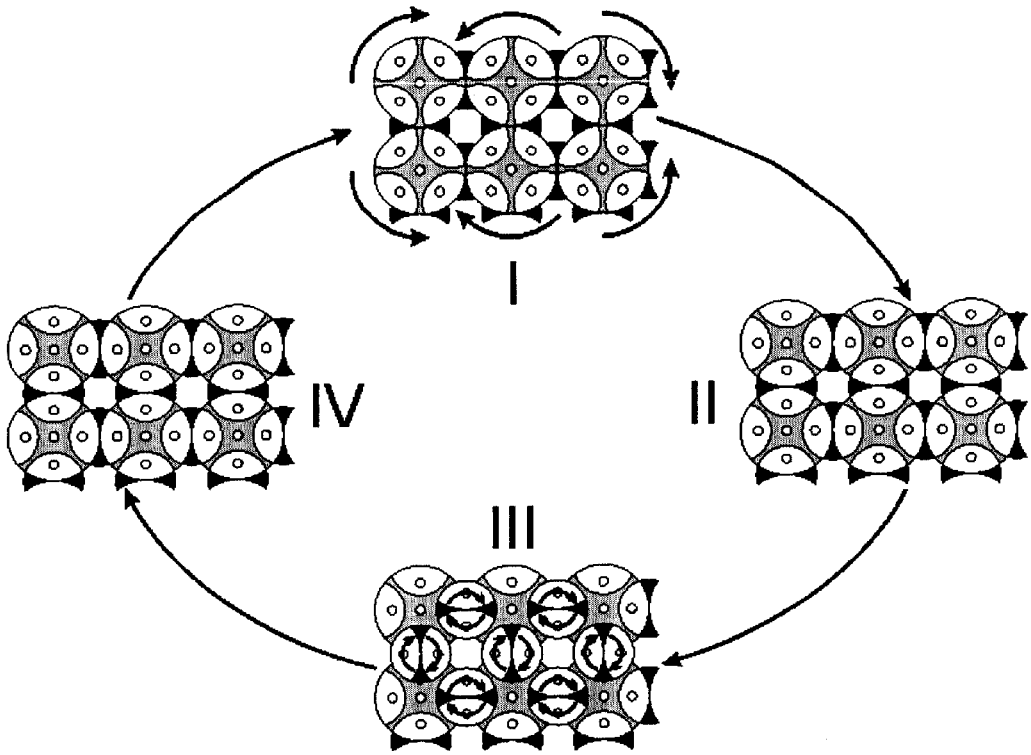
FIG. 5 illustrates a top view of a select number of components from the grouping of components of FIG. 4, and their change of position at four stages.

A three-dimensional schematic of moving elements is shown in FIG. 3. Further, after connecting several moving elements in assembly shown in FIG. 4, we illustrate the compound action of the mechanism. The sequence of element rotations is shown in FIG. 5, Notations introduced in this figure correspond to the following process elements: I—rotation of all homgears from their initial positions for angle 45°; II—rotation of gripping forks for angle 180°; III—intermediate position of the gripping forks is shown during their rotation; IV—rotation of the horngears for angle 45° into their initial positions.

Figure 6:
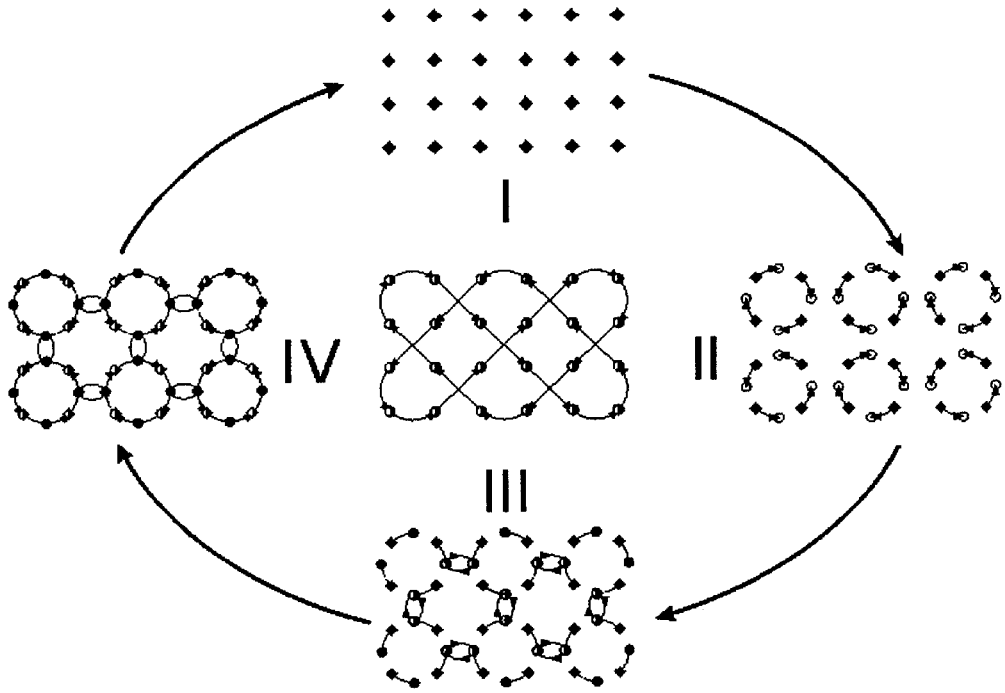
FIG. 6 illustrates a top view directional movement diagram of the motion of the components shown in FIG. 5.

FIG. 6 demonstrated the carrier movement in the course of braiding process: I—initial positions; II—carrier transition to the adjacent position; III—transition of the neighbor carriers from one horngear to the other; IV—transition of carriers into their initial position; illustration in the center of the figure shows straightened paths of the carriers during the described process.

Figure 7:
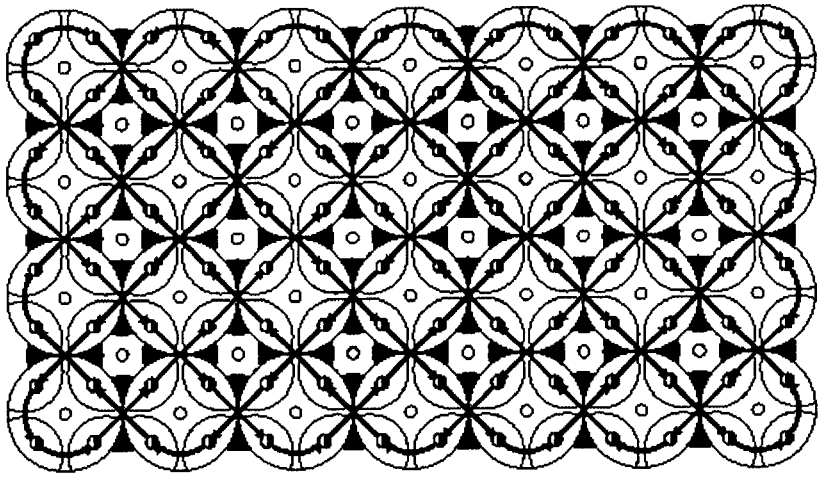
FIG. 7 illustrates a top view of directional movement for the entire module shown in FIG. 5.

FIG. 7 shows straightened paths of carriers superposed over the schematic of the moving elements.

Figure 8:
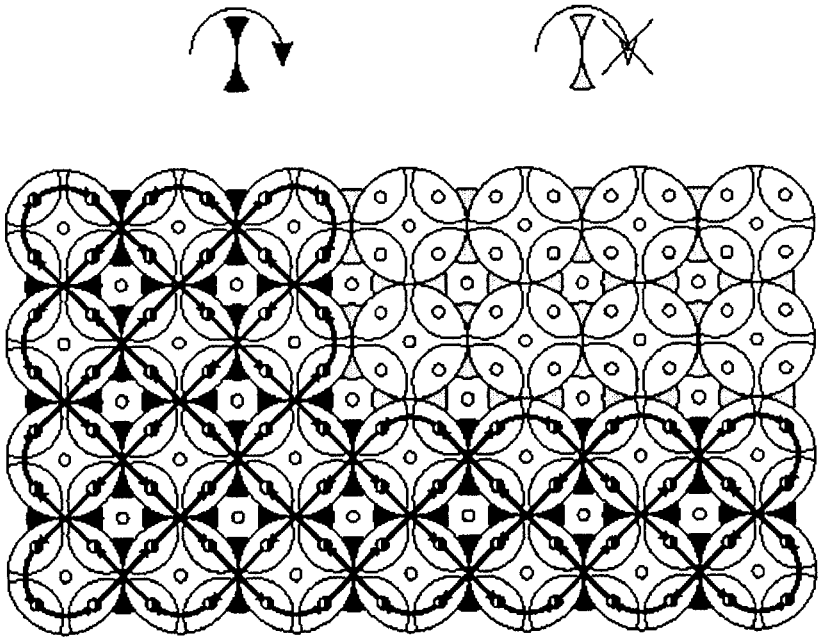
FIG. 8 illustrates a top view of selective activation and directional movement of components within the module shown in FIG. 7.
Figure 9:
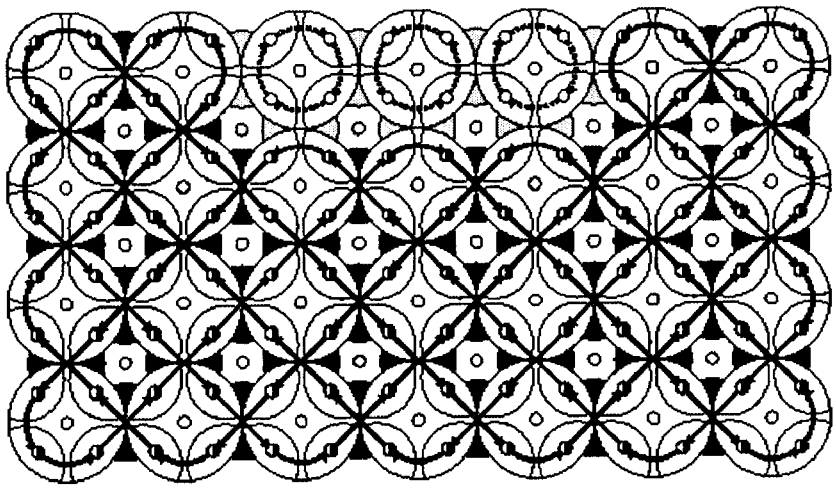
FIG. 9 illustrates a top view of selective activation and directional movement of components within the module shown in FIG. 7.
Figure 10:
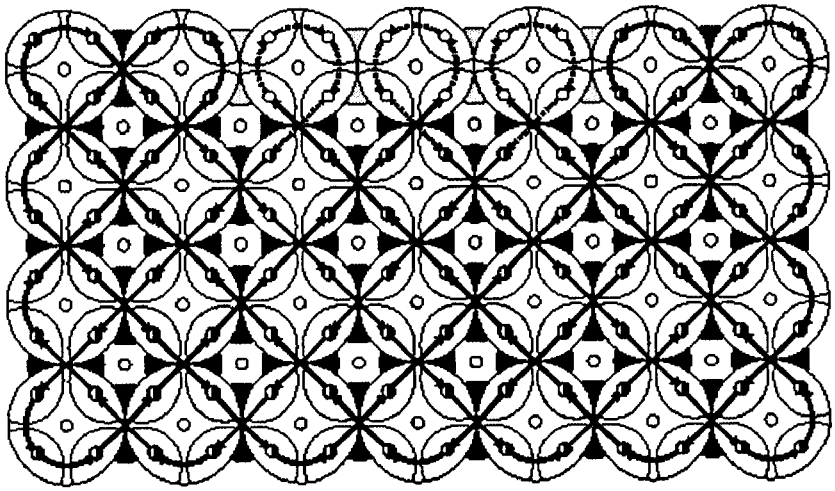
FIG. 10 illustrates a top view of selective activation and directional movement of components within the module shown in FIG. 7.
Figure 11:
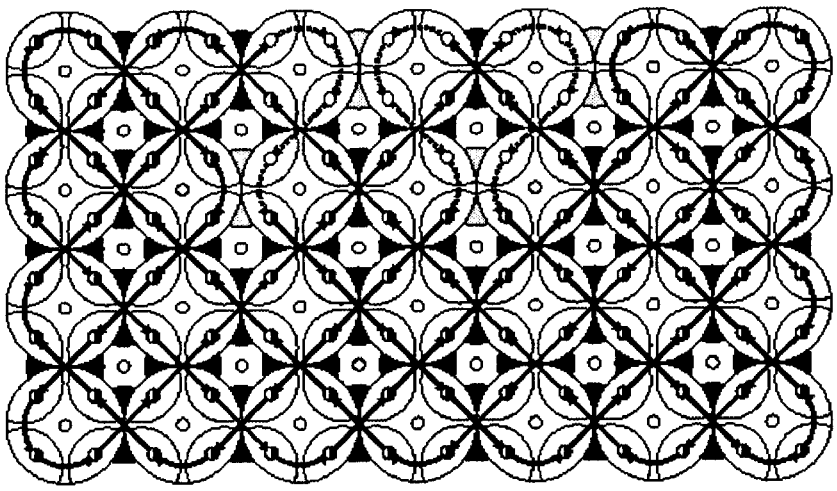
FIG. 11 illustrates a top view of selective activation and directional movement of components within the module shown in FIG. 7.
Figure 12:
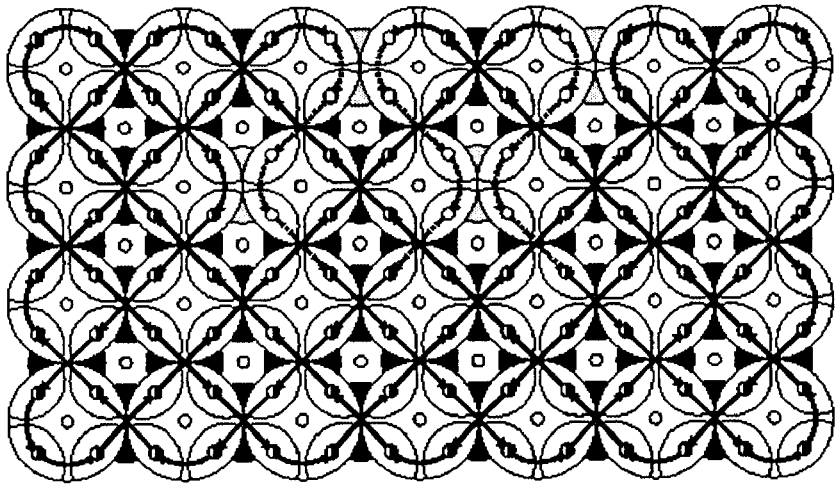
FIG. 12 illustrates a top view of selective activation and directional movement of components within the module shown in FIG. 7.
Figure 13:
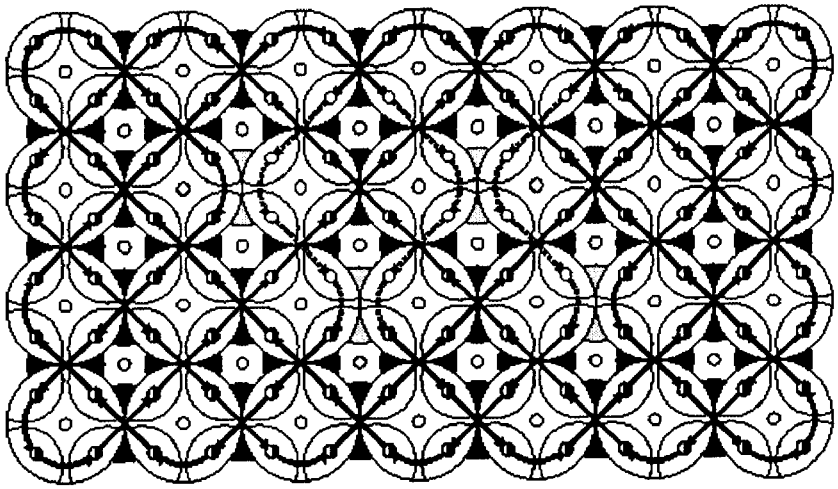
FIG. 13 illustrates a top view of selective activation and directional movement of components within the module shown in FIG. 7.
Figure 14:
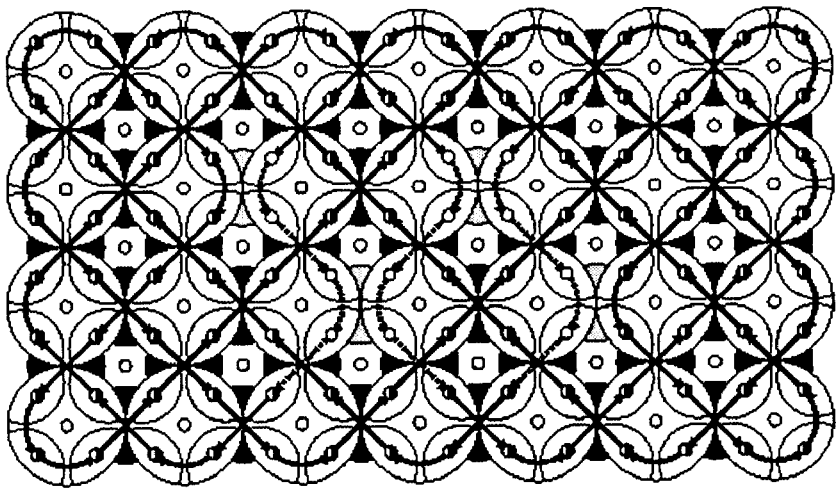
FIG. 14 illustrates a top view of selective activation and directional movement of components within the module shown in FIG. 7.
Figure 15:
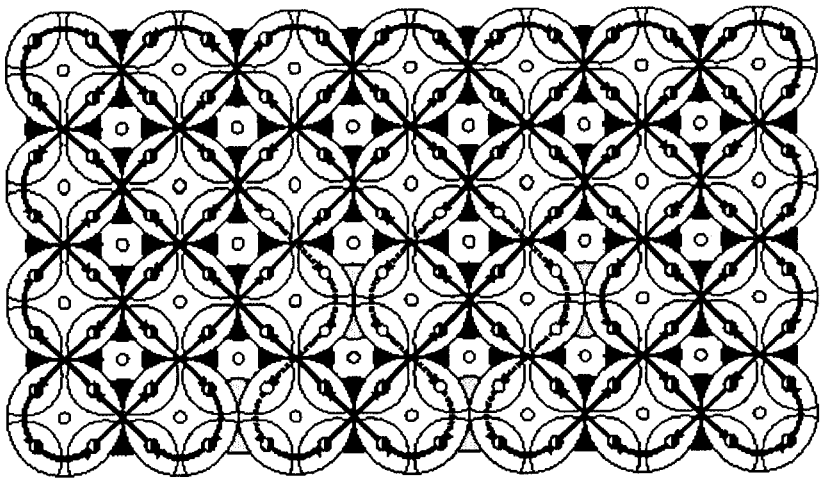
FIG. 15 illustrates a top view of selective activation and directional movement of components within the module shown in FIG. 7.
Figure 16:
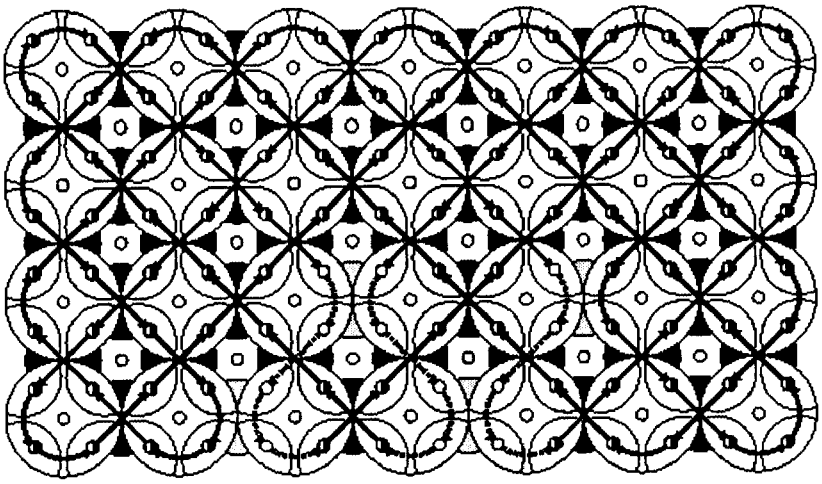
FIG. 16 illustrates a top view of selective activation and directional movement of components within the module shown in FIG. 7.
Figure 17:
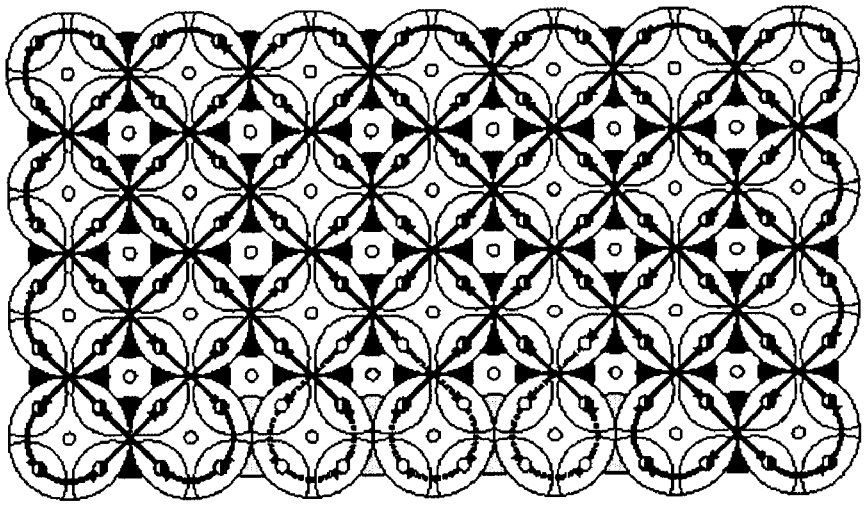
FIG. 17 illustrates a top view of selective activation and directional movement of components within the module shown in FIG. 7.
Figure 18:
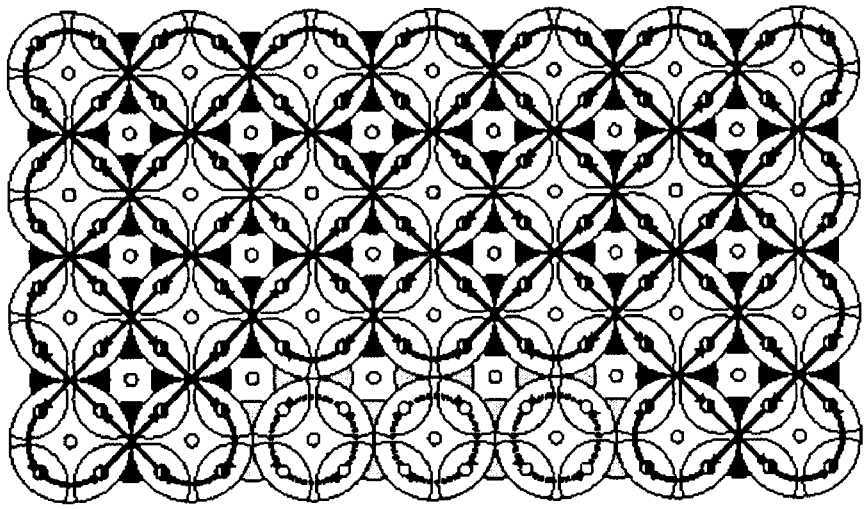
FIG. 18 illustrates a top view of selective activation and directional movement of components within the module shown in FIG. 7.

FIG. 8 (top, left) shows schematic notation of unblocked (moving) gripping fork, while FIG. 8 (top, right) shows the same for the blocked gripping fork. Further, main part of FIG. 8 illustrates straightened paths of carriers with the partially blocked area of the braider, which is specific for braiding Lshaped performs.

Further FIGS. 9–18, demonstrate the sequence of incorporation and blocking different gripping forks in the course of braiding, when realizing continuos variation of the braided perform cross-section. Dashed line corresponds to the empty carrier paths.

Figure 19:
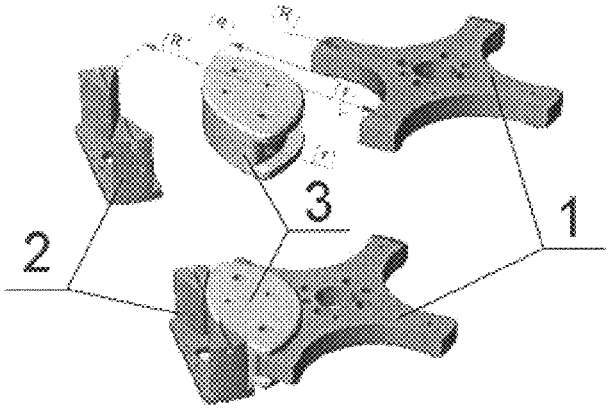
FIG. 19 illustrates a perspective view of components of the machine according to the present invention in relational configuration.
Figure 20:
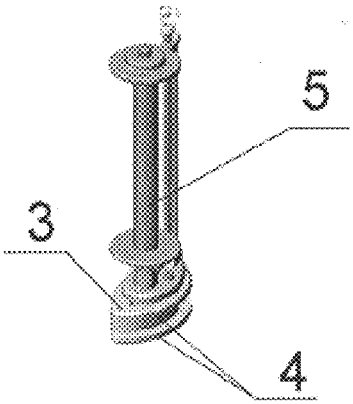
FIG. 20 illustrates a perspective view of additional components of the machine according to the present invention in relational configuration.

FIG. 19 shows realistic parts of the braiding machine; those correspond to the parts earlier shown in schematic in FIG. 2. FIG. 20 shows the attachment of a standard carrier 5 to the carrier driver 3.

Figure 21:
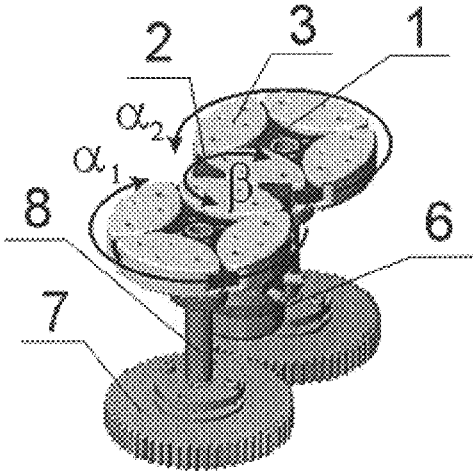
FIG. 21 illustrates a perspective view of interaction and rotation of components of the machine according to the present invention.
Figure 22:
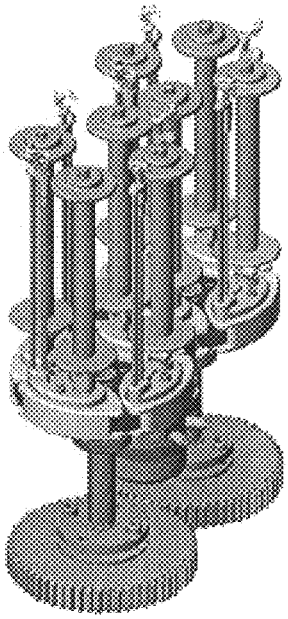
FIG. 22 illustrates a perspective view of additional components assembled with those of FIG. 21.

All gripping forks 2 have individual drives 6, as shown in FIG. 21; in a particular embodiment those are pneumatic. These individual drives 6 of gripping forks 2 can do unilateral rotation or, as in the particular embodiment, they can do a reverse rotation at an angles rotation $\beta=+/-180°$. Synchronization of the horngear turns and their respective rotations $\alpha$ are carried out by drive gears 7 connected among themselves by hollow shafts 8. Such design allows for the arrangement of four spindles 5 simultaneously on each horngear 1, as shown in FIG. 22. Usually braiding machines with horngear drive having respective gear mechanisms allowing to install only two spindles on each horngear, Thus, the present invention has a unique, compact design permitting four spindles per each horngear. Accordingly, the dimensions and weight of the braiding machine are reduced by a factor of two in the present invention, which translates into a significantly higher operational speed and greater flexibility of manufacturing complex shape products.

Figure 23:
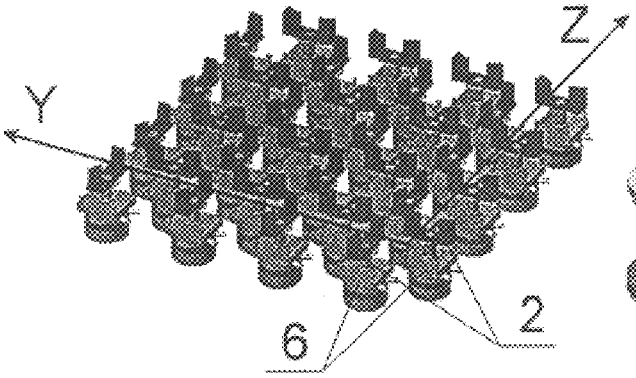
FIG. 23 illustrates a perspective view of additional components of a module of the machine according to the present invention.
Figure 24:
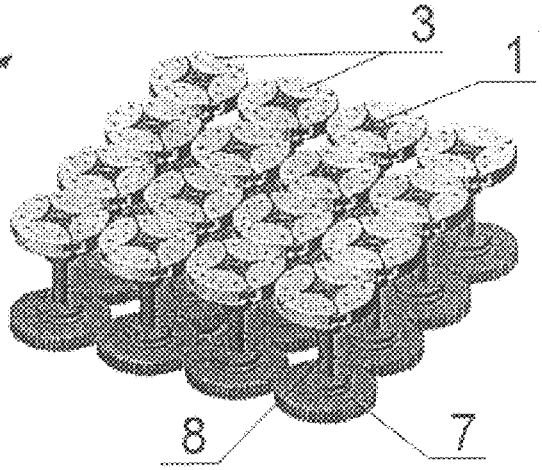
FIG. 24 illustrates a perspective view of additional components of a module of the machine according to the present invention.
Figure 25:
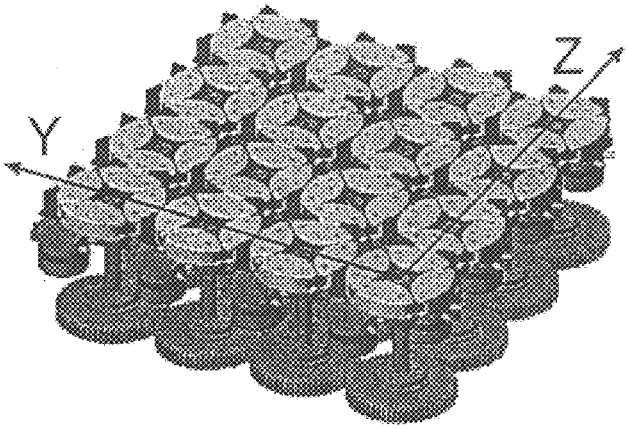
FIG. 25 illustrates a perspective view of the combination of FIG. 24 components assembled with those of FIG. 23.
Figure 26:
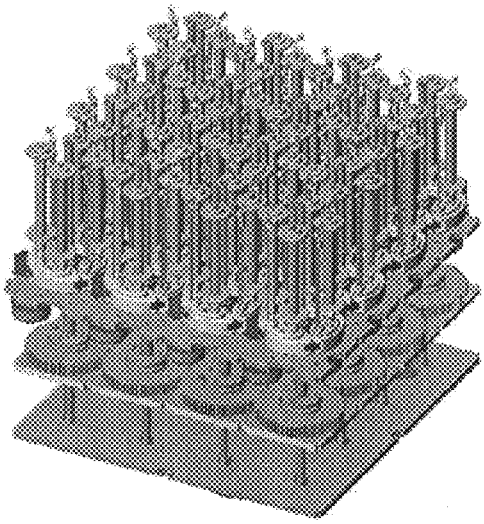
FIG. 26 illustrates a perspective view of the combination of FIG. 24 components assembled with those of FIG. 23 and FIG. 25.
Figure 27:
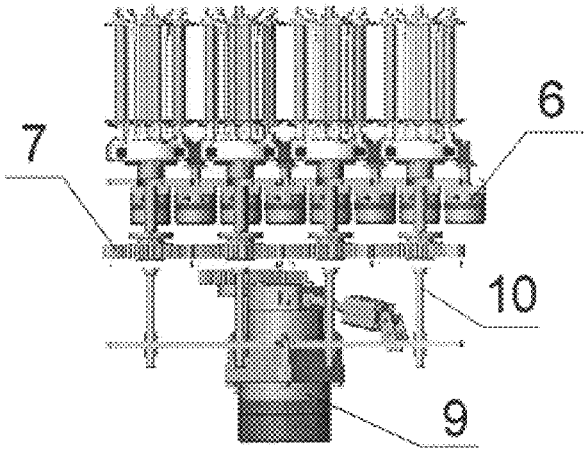
FIG. 27 illustrates a front view of a section of components from a module in mechanical connection according to the present invention.

Furthermore, drives 6 and gripping forks 2 in the machine settle down in two directions Y and Z, as shown in FIG. 23. Horngears 1 with the drive gears 7 are also installed in two directions, as shown in FIG. 24. The joint arrangement of horn gears 1 and gripping forks 2 is shown in FIG. 25. Sixteen horngears, four in each of the direction Y and Z, which form a universal module as shown in FIG. 26. The universal module has an individual drive 9 aimed at applying rotational motion to homgears 1, as shown in FIG. 27. Preferably both types of individual drives 6 for gripping forks and drives 9 for horngears are pneumatic rotation actuators, but possibly individual drive types are not limited to the above.

Figure 28:
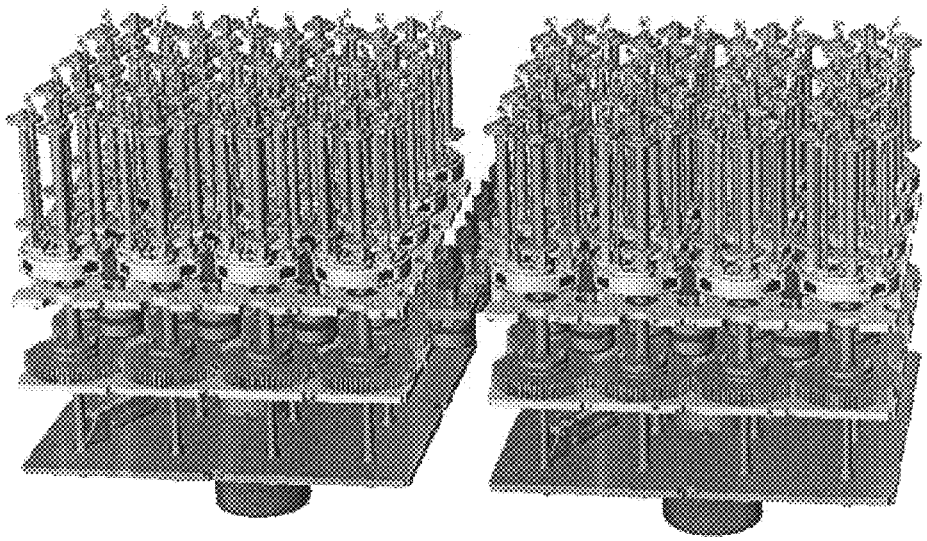
FIG. 28 illustrates a perspective view of a two-module assembly.
Figure 29:
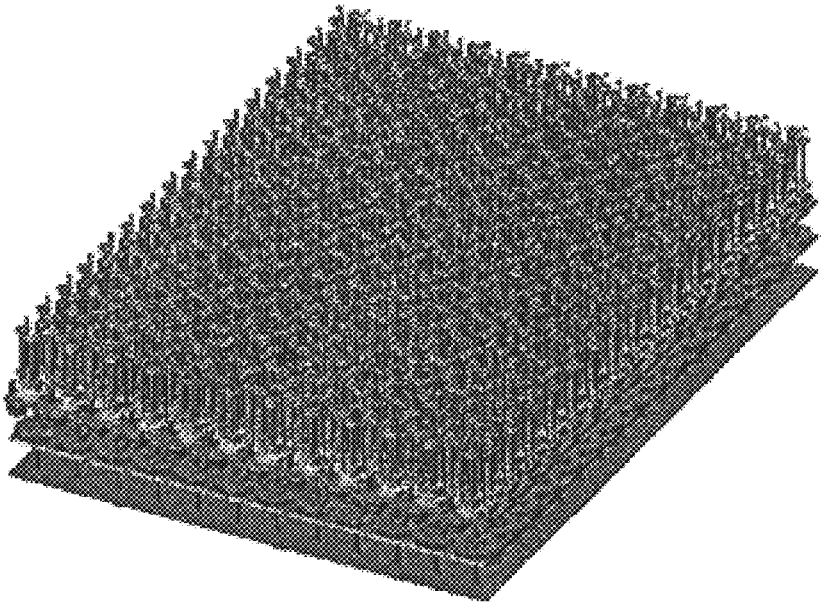
FIG. 29 illustrates a perspective view of a multi-modular, square configuration assembly.

Importantly, the module is equipped with a longitudinal (axial) yam supply system 10, where axial yarns are inserted through hollow shafts 8 of the homgears 1. One universal module simultaneously operates the movement of 64 yarn carriers. As shown in FIG. 28, all base plates of the module allow the connection of a number of modules in multi-module machine, depending upon the required perform dimensions and cross-section shape. As shown in FIG. 29, the multi-modular functionality in principle, the assembly of any desirable number of modules to provide the braiding equipment for any specific product requirement.

Additionally, any of the various cross-sectional shapes may be manufactured on a single machine according to the present invention. The machine having at least one modular group (FIG. 3*c*) comprising at least two cells (a cell is shown in FIG. 3*a*) or carriers or spindles each including at least two yarn carriers or spindles placed on a horngear. Advantageously, the compact horn gear carrier driver and gripping fork configurations (shown in FIGS. 2 and 3) allow forming a modular group by connecting at least two cells having common drive via gripping forks having individual drives (shown in FIG. 3*b*). Further, individual modular groups may be assembled with other modular groups in an arbitrary configuration via the same gate design of FIGS. 2*d*, 3*c* for providing smooth transition of each of the four yarn carriers or spindles per cell between adjacent modular groups. Moreover, the machine according to the present invention provides the capacity to link any desirable number of modules via the same gate design of FIGS. 2*d*, 3*c* and to provide smooth transition of the spindles between adjacent moduli. This permits the production of complex configurations of the moduli assembly thereby enabling the manufacture of 3-D braided complex, unitary fiber preforms in a multiplicity of cross-sectional shapes and a wide range of dimensions when compared with traditional or prior art machines. Also, the multi-modular construction of the machine and compact configurations of horngear, carrier drive and gripping fork permit the manufacture of comparatively large cross-sections on a comparatively small size machine due to the modular construction and compact horn gear configuration with each module.

Furthermore, the machine according to the present invention is capable of producing the complex-shaped, 3-D braided preform structures in a continuous series, i.e., one preform after another without stopping the machine. This continuous manufacture of preforms is possible for any of the cross-sectional shapes and sizes produced on the machine. The control system permits selective activation and deactivation of moduli such that changing the combination of activated moduli changes the cross-sectional shape of the preform produced on the machine, i.e., the control system permits selective activation and deactivation of moduli on-the-fly, without having to stop the machine for alterations once an adequate number of moduli are connected. This combination of multi-modular configuration and controls for activation and deactivation of them is what permits the manufacture of a multiplicity of cross-sectional shapes on the same machine. The combination of multiple modules shown in FIG. 30 permits the formation of a wide range of cross-sectional shapes and sizes for preform structures, as illustrated, by way of example and not limitation, FIGS. 31–34.

Figure 30:
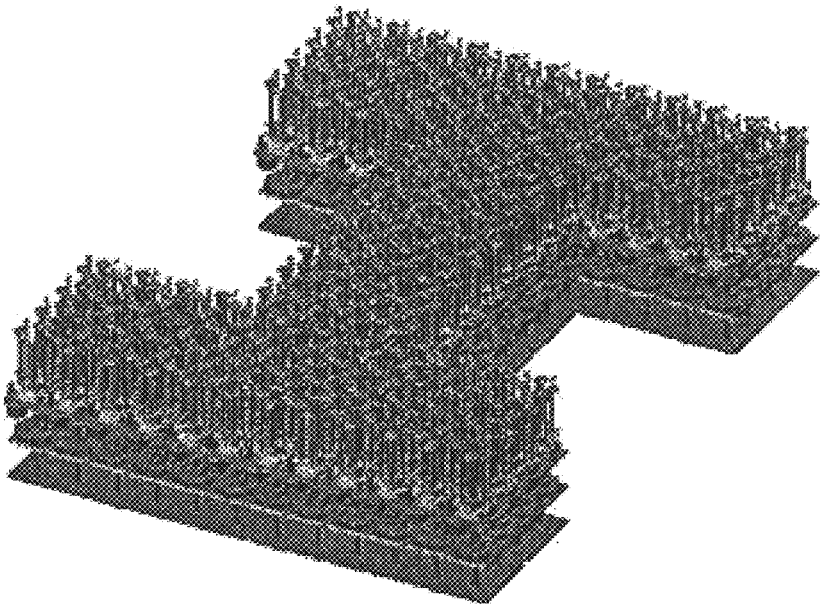
FIG. 30 illustrates a perspective view of a multi-modular, I-beam configuration assembly.
Figure 31:
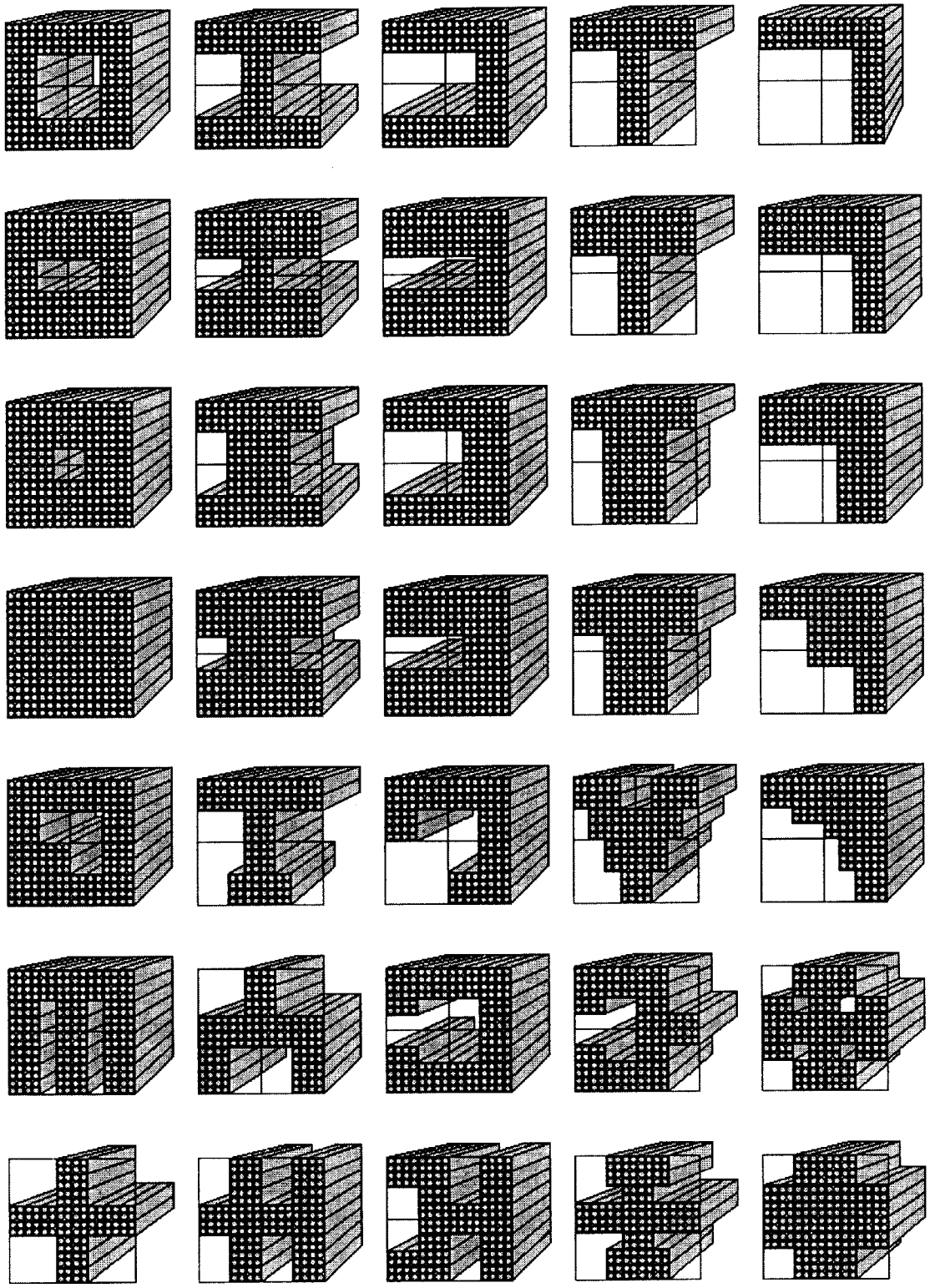
FIG. 31 illustrates diagrams of various multi-modular configurations of the machine for making complex-shaped cross-sectional structures.
Figure 32:
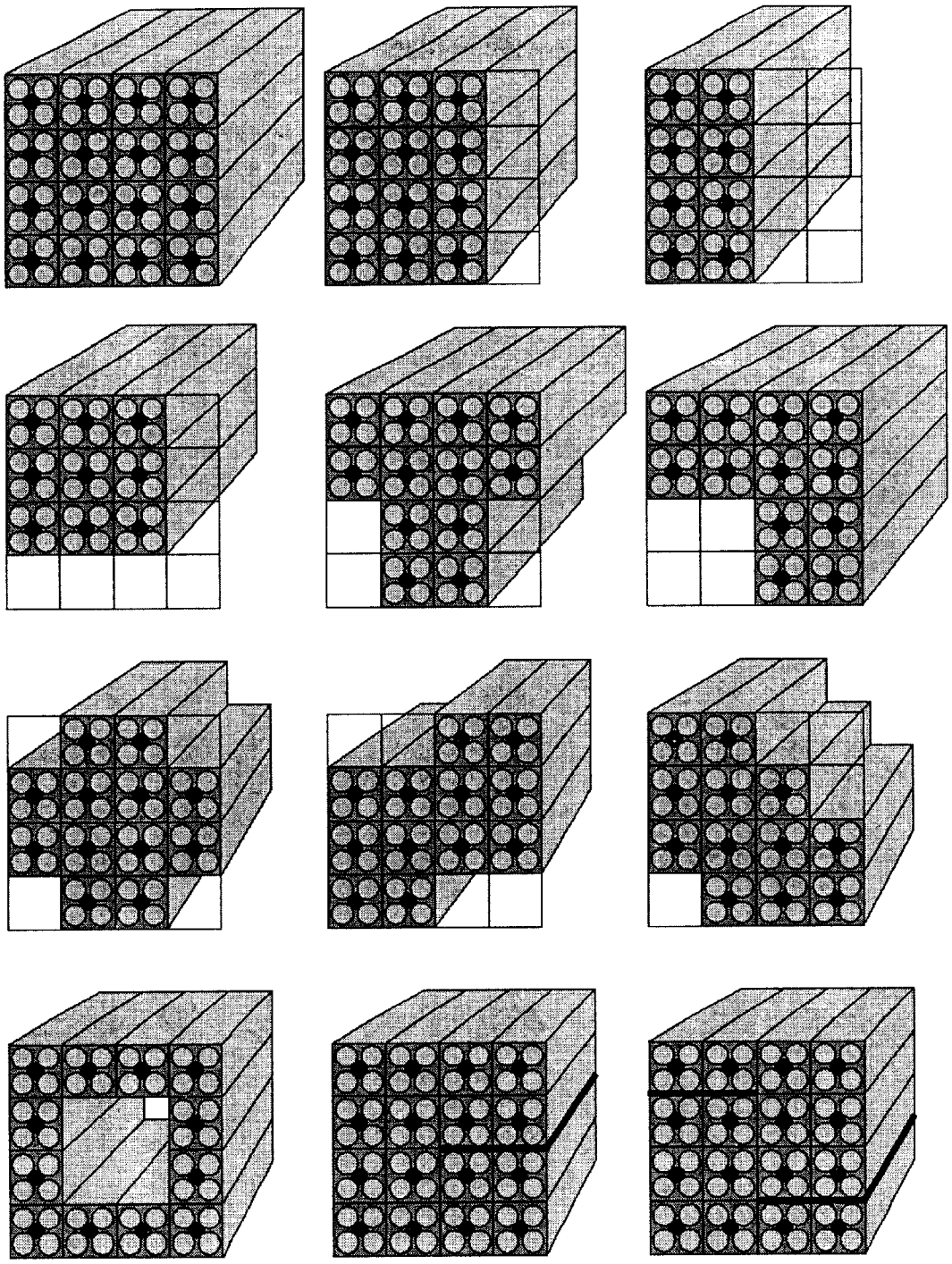
FIG. 32 illustrates diagrams of various multi-modular configurations of the machine for making complex-shaped cross-sectional structures.
Figure 33:
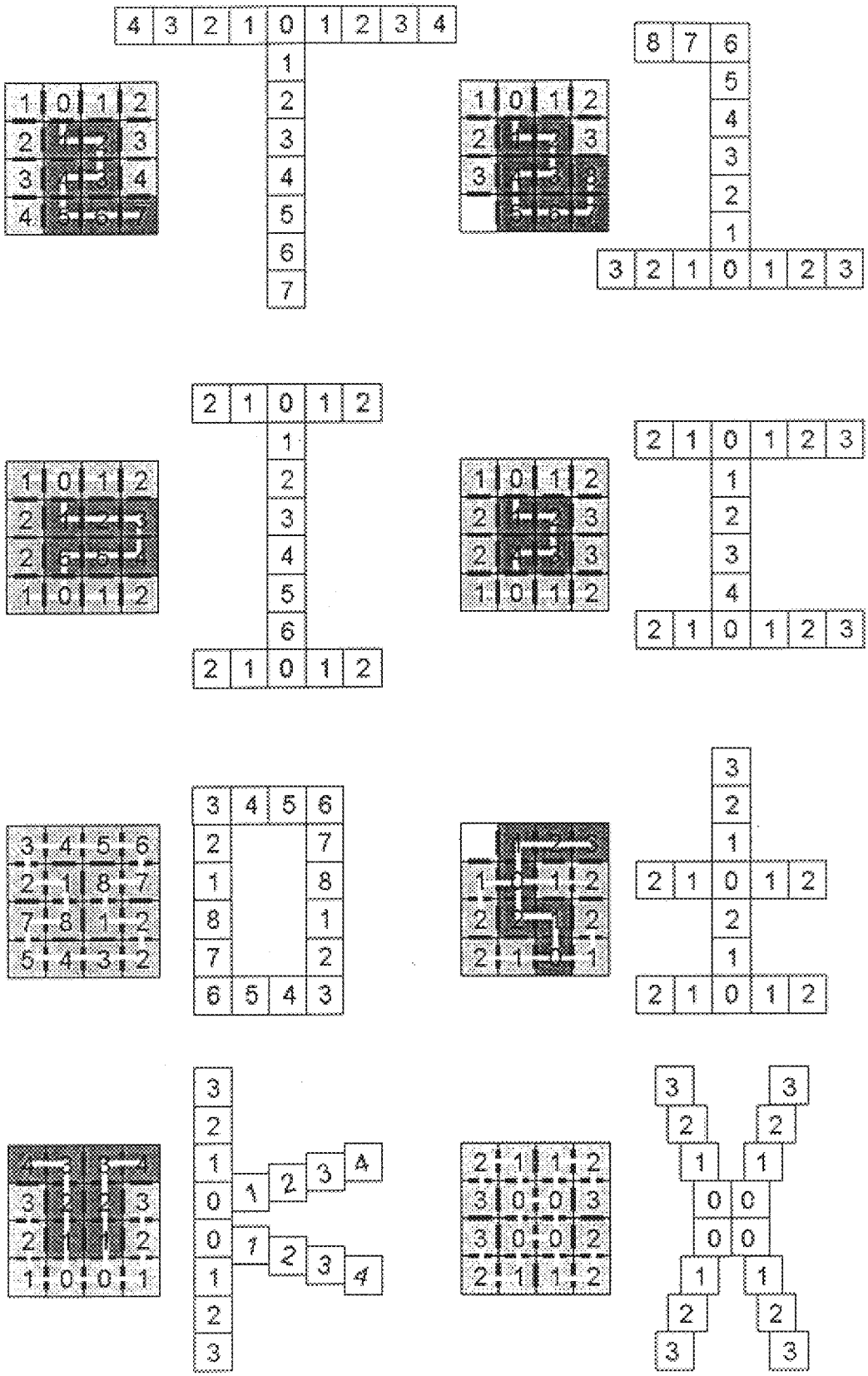
FIG. 33 illustrates diagrams of various multi-modular configurations of the machine for making complex-shaped cross-sectional structures.
Figure 34:
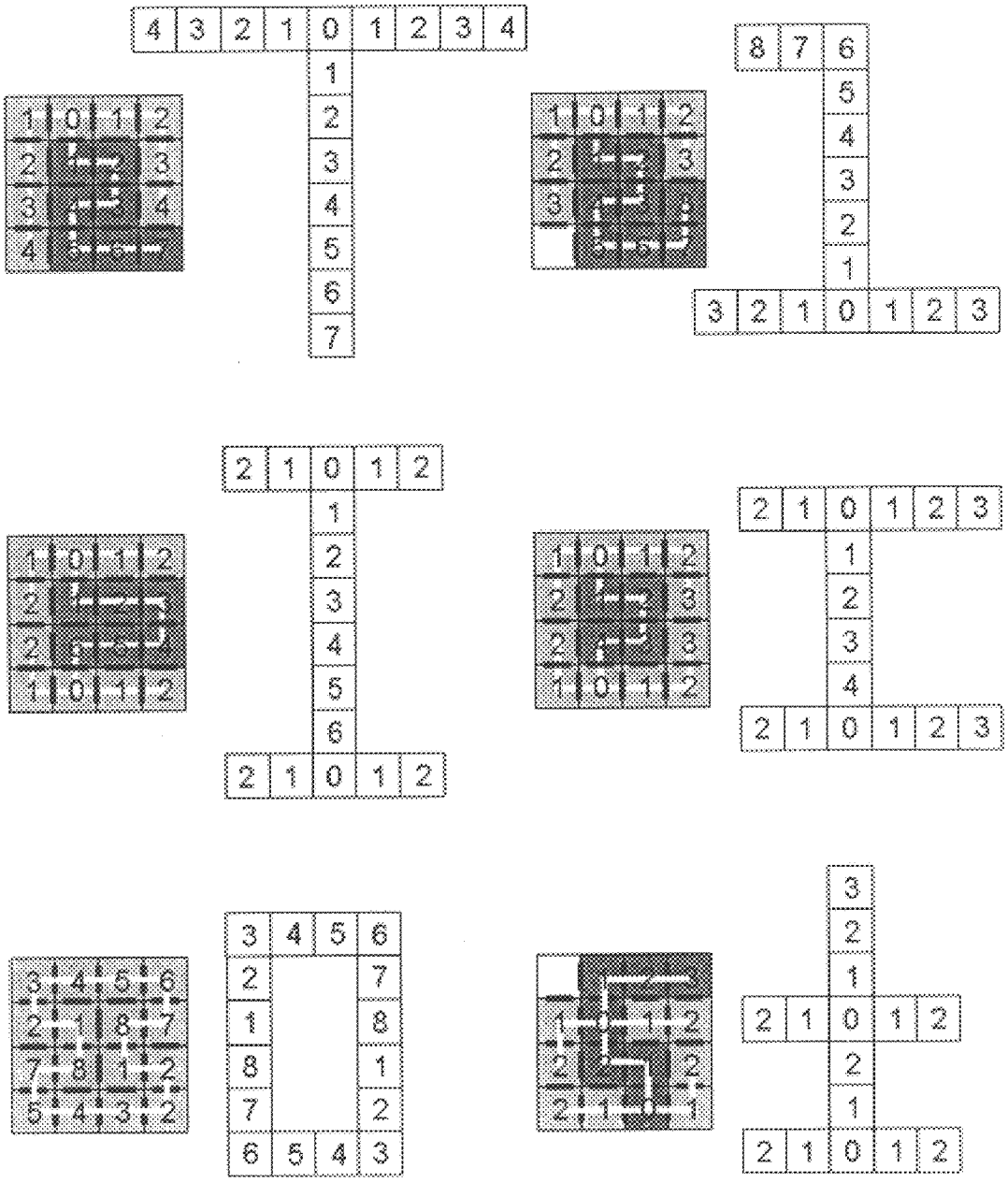
FIG. 34 illustrates diagrams of various multi-modular configurations of the machine for making complex-shaped cross-sectional structures.

Additionally, because a multiplicity of modules may be attached to enlarge the machine within practical space and other limitations, as shown in FIG. 30, the machine is scable to make cross-sectional areas in a broad range, which is equal to the cross-sectional dimensions of a preform made on or using a single module, to a maximum cross-sectional dimensions equal to the dimensions made on or using a single module times the number of modules combined in series in either direction of the machine. The cross-sectional shape options include but are not limited to T, I, J, L, U, O, C, solid square or rectangle, open square or rectangle, solid circle or oval, open circle or oval, semi-circle, and the like, as illustrated in the attached FIGS. 31, 32, 33, and 34.

Additional capabilities of the multi-modular machine include the flexibility of making a variety of complex shapes automatically, making large-sized cross-sectional dimensions, which are limited only by the number of modules that may be assembled and activated on a given machine, on-the-fly changes between different types of shapes on a single machine, and making thick walled complex shaped preforms, which provide preforms having increased strength and other properties.

Though the achievable preform architecture, including desirable fiber directions and packing density, does not essentially depend on the executive mechanism of a 3-D braiding machine, a consistency and uniformity of the architecture may significantly depend. It is difficult to achieve high consistency and uniformity on a hand-operated or partly automated braiding mechanism. Only a fully automated braiding machine, where the operation cycle is identically repeated for each iteration of the manufacturing of a preform, usually thousands of times, provides a consistent quality product. An automated, computer controlled, highly reliable multi-modular 3-D braiding machine described here, fully satisfies this requirement. So the core aspect of this innovation is achieving a significantly higher level, compared to the prior art, in automation, versatility and reliability of the 3-D braiding process and its machinery realization.

An important feature of this innovative 3-D braiding process is active, computer-controlled management of the process, set forth in FIG. 1. It allows one to instantly and, at the same time, continuously, without readjusting machine, switch to manufacturing of a different cross-sectional shaped products. In principle, any sequence of allowable, broad variety products can be continuously manufactured without interrupting machine operation. In support of reliability and continuity of the process, a special system of automated control over positioning of the moving parts (e.g., horn gears, gates and yarn carriers) is implemented, and shown in FIG. 1.

Importantly, it is anticipated that the cost of processing 3-D braided preforms using this innovation will be significantly reduced, primarily due to a radically increased efficiency of control over all moving parts of the machine and optimizing the machine itself, and more precisely, its modular configuration, for each specific type of product. Also serial production eliminates yarn loss due to set-up and machine changes associated with a standard, non-modular machine, as well as errors, other inconsistencies and abnormalities present in manual manufacturing of 3-D braided structures.

As an example of one specific preferred embodiment, consider a single-module machine with dimensions of the base plate 22"×22". The machine allows using maximum of 64 braider yarn carriers or cells and 16 axial yarn bobbins. Each carrier can accommodate a bobbin with about 650' 12K T300 carbon yarn or 130' 60K yarn. The required draw-in yarn length is 6' at the beginning and 2' at the end. This machine set up allows one to produce, for example, continuous square cross section rope with 45° braid angle having length 450' (using 12K yarn) or 83' (using 60K yarn). The axial yarn supply is virtually unlimited due to their carriers being stationary and placed outside the braiding machine. One operator can do all the necessary braider set up in one hour. Operational speed of the present braiding machine embodiment is up to 90 cycles per minute. In one process realization, it took 3 hours to produce a square rope having 0.75"×0.75" cross section and 105' length with braid angle 30° using 60K yarn. In another process realization of the preferred embodiment according to the present invention, when using the same yarn size, a T-section rope has been produced with dimensions; 1.46" at the base, 1.14" height and 0.238" wall thickness.

Wile material properties may be improved, the machine & method are the most important matters; client directs to focus on the machine & method not the finished product characteristics in this patent application. Although it may be possible manufacture a 3-D braided product by hand, several properties are negatively affected, including but not limited to consistency of fabric characteristics due to non-uniformities.

The integral preform structures produced on the machine are continuously and consistently formed by programmable controls of the machine. As best shown in FIG. 1, the control system includes a computer processor, sensors to detect and determine machine component position, drive system, including drive motors, gears and connectors, including the common horngear drive and individual gripping fork drives, gears, yarn system input and takeup, and individual bobbin movement across the entire area of the machine, either single or multi-modular configuration. The control system is preferably pneumatic, although other control means are possible, including but not limited to hydraulic, pneumatic, electric, and the like. Every module has its own control, i.e., each module can be selectively activated and deactivated.

The present invention is further directed to a method for making a complex shaped, three-dimensional engineered fiber preforms having a unitary, integral and seamless structure. The present invention is also directed to a method of manufacturing 3-D braiding structures using the machine, according to the present invention. There are two principal stages in the entire process according to the present invention: (i) a preparatory stage of machine set up and (ii) braiding cycle per se, The preparatory stage includes winding yarns on the bobbins, installation of bobbins with yarns on the carriers and then on braiding machine, The method further includes, in a preparatory stage of the machine set-up, the steps of providing at least one yarn system on a multiplicity of spindles or cells on each of a plurality of horn gears, the spindles or cells arranged in groups of at least two, preferably four spindles or cells per module; affixing the ends of the yarns at a take-up; activating the machine rotating the spindles according to the braiding cycle per se, set forth hereinbelow.

Figure 35:
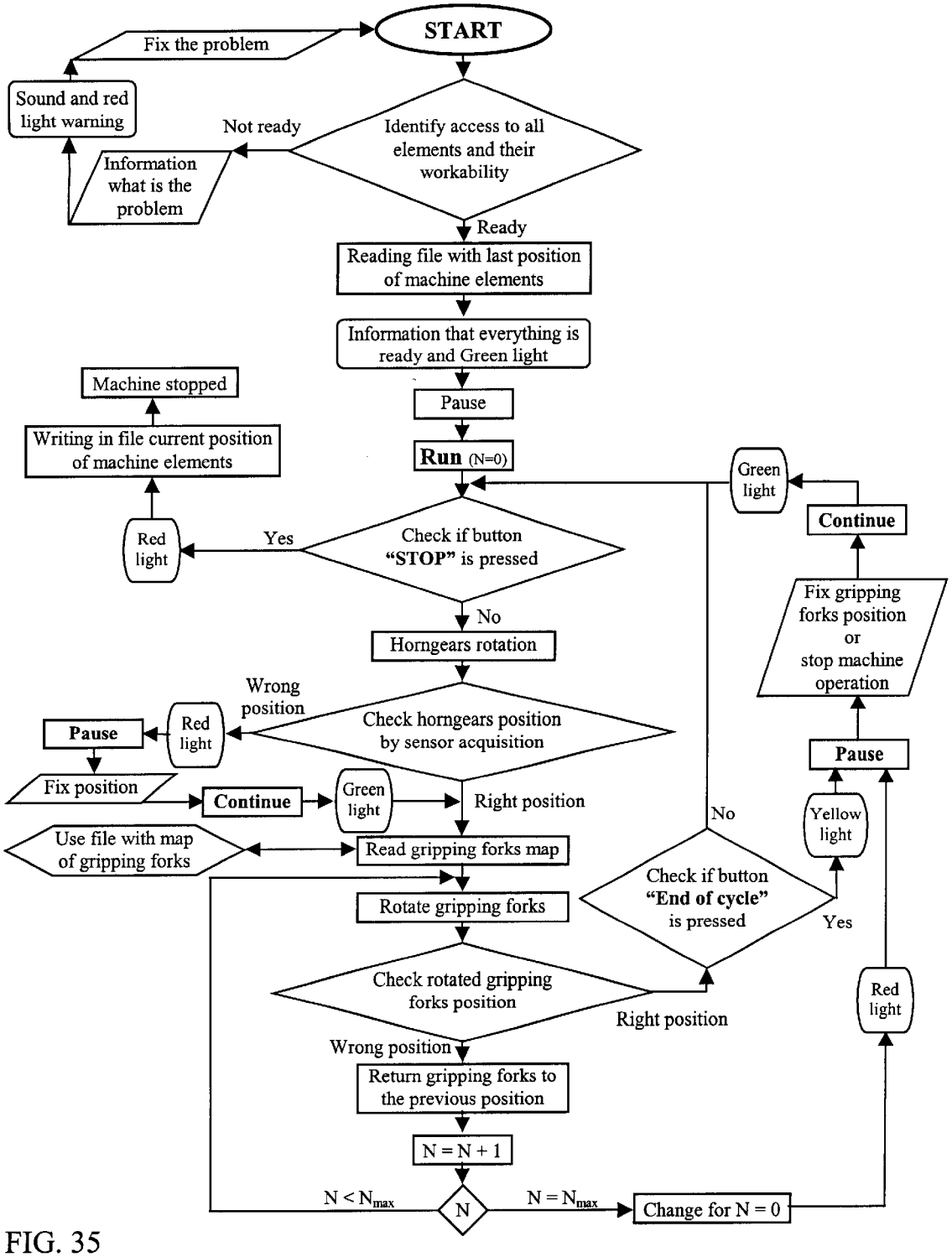
FIG. 35 shows a flow chart of the braiding cycle steps according to the present invention.

The braiding cycle explained in detail in the Flow Chart of FIG. 35 includes the following major operations as consecutive steps of one practical braiding process realization:

1. START the machine operation control software.
2. The control software (i) identifies access to all machine elements and verifies their workability, (ii) reads information from the file what the last positions of the machine elements and the last controlling regimes are, (iii) checks up all machine systems, including lights, buttons, air system, air pressure, positions of horngears and gripping forks. If anything is NOT READY then the control software displays the problem by activating sound signal and red light simultaneously. After the problem is fixed, the control system goes to START again. If everything is READY this time, the control software turns on the green light, checks up elements of the machine in the last position and then go to PAUSE. The machine is ready to RUN.
3. RUN the machine.
4. Check up button STOP. If the button is pressed, turn on red light, writing in file current positions of horngears, then the machine is stopped. If the button is not pressed go one step forward in rotating horngears.
5. Check up horngear position by sensor acquisition, If the position is WRONG, turn on red light and go to PAUSE. Fix horngear positions and CONTINUE. If all horngears have right positions now, read next step of rotated gripping forks map from file.
6. Rotate gripping forks.
7. Check up positions of rotated gripping forks. If any of gripping forks have WRONG position, go to the SUBROUTINE. If all gripping forks have right position, check up button END OF CYCLE. If the button is not pressed, go to the next cycle, step 4 above. If the button is pressed, turn on yellow light and go to PAUSE. Then CONTINUE—turn on green light and go to the next cycle, step 4 above.

The SUBROUTINE realizes the following cycle:

(a) Return gripping forks to the previous position. Then increase current value of N by 1.

(b) Compare the new value of N with $N_{max}$. If $N<N_{max}$, go to rotate gripping forks again, step 4 above. If $N=N_{max}$, prescribe N=0, then turn on red light and go to PAUSE.

(c) Fix position(s) of the gripping forks and CONTINUE.

We claim:

1. A machine for producing three-dimensional engineered fiber preforms comprising:

at least one module including at least one module cell that is comprised of at least two horngears, at least two carrier drivers, and at least one rotary gripping fork, in mechanical connection to each other;

each horngear having a symmetrical horngear cell with complementary sections for carrying each of the carrier drivers;

each horngear connected to a horngear drive motor;

each rotary gripping fork having an independent drive;

each module cell having a compact configuration, which is defined by the symmetrical horngear cells matched with the carrier drivers to form a circular area, with a rotary gripping fork matched with and positioned in between the carrier drivers;

each of the at least two carrier drivers include a carrier with a yam supply thereon; and a computer control system for operating the machine in a programmable, predetermined pattern of movement of the carrier drivers by the respective horngear and the rotary gripping fork;

wherein activation of the at least one module selectively moves the carrier drivers individually and simultaneously across the at least one module by rotation of the homgears and independent rotation of the rotary gripping fork, for producing a complex shaped threedimensional braided fiber perform having a unitary, integral construction from a plurality of fibers.

2. The machine according to claim 1, wherein each module cell includes eight carrier drivers.

3. The machine according to claim 1, wherein the at least one module includes a plurality of module cells connected adjacent to one another via rotary gripping forks.

4. The machine according to claim 1, wherein the carrier drivers move in circular trajectories accordingly with circular movements of the horngears, which are rotated by a module drive motor mechanically connected thereto.

5. The machine according to claim 1, wherein the at least one module is a plurality of connected modules and wherein a connection of adjacent modules is formed by a gate design comprising rotary gripping forks the match adjacent modules together and that function exactly as the rotary gripping forks within a module, for moving the carrier drivers between adjacent modules.

6. The machine according to claim 5, wherein the plurality of modules are connectable in different configurations to form a variety of cross-section of the preforms produced thereon.

7. The machine according to claim 1, wherein the control system is connected to the horngear drive motors and to the independent rotary gripping fork drives to provide individual control of carrier drivers movement according to a step-wise continuous, repetitious pattern.

8. The machine according to claim 1, wherein the control system includes a a programmed pattern to selectively rotate the rotary gripping forks and the horngears.

9. The machine according to claim 8, wherein the programmed pattern includes a complex-shaped 3-D braided preform structure having at least two different cross-sectional shapes in the preform.

10. The machine according to claim 8, wherein the programmed pattern includes at least two different complex-shaped 3-D braided preform structures that are manufactured in continuous series.

11. The machine according to claim 8, wherein the programmed pattern includes 3-D braided preforms having cross sectional shapes selected from the group consisting of T, I, J, L, U, O, C, solid rectangle, open rectangle, solid circle, solid oval, open circle, open oval, semi-circle.

12. A machine for producing three-dimensional engineered fiber preforms comprising:

a plurality of modules seamlessly connected adjacent to one another and having a gate design between adjacent modules comprising rotary gripping forks that match adjacent modules together and that function exactly as rotary gripping forks within each module for moving carrier drivers between adjacent modules, wherein each module comprises at least one module cell that is comprised of at least two horngears, at least two carrier drivers, and at least one rotary gripping fork, in mechanical connection to each other;

each horngear having a symmetrical horngear cell with complementary sections for carrying each of the carrier drivers;

each horngear connected to a horngear drive motor;

each rotary gripping fork having an independent drive;

each module cell having a compact configuration, which is defined by the symmetrical horngear cells matched with the carrier drivers to form a circular area, with a rotary gripping fork matched with and positioned in between the carrier drivers;

each of the at least two carrier drivers include a carrier with a yarn supply thereon; and a computer control system for operating the machine in a programmable, predetermined pattern of movement of the carrier drivers by the respective horngear and the rotary gripping fork;

wherein activation of the plurality of modules selectively moves the carrier drivers a individually and simultaneously across the modules by rotation of the horngears and independent rotation of the rotary gripping fork, for producing a complex shaped three-dimensional braided fiber perform having a unitary, integral construction from a plurality of fibers.

13. The machine according to claim 12, wherein each module cell includes eight carrier drivers.

14. The machine according to claim 12, wherein the at least one module includes a plurality of module cells connected adjacent to one another via rotary gripping forks.

15. The machine according to claim 12, wherein the carrier drivers move in circular trajectories accordingly with circular movements of the horngears, wherein the homgears are rotated by a drive motor mechanically connected thereto.

16. The machine according to claim 12, wherein the plurality of modules are connectable in different configurations to form a variety of cross-section of the preforms produced thereon.

17. The machine according to claim 12, wherein the control system is connected to the drives to provide individual control of carrier drivers movement according to a step-wise continuous, repetitious pattern.

18. The machine according to claim 12, wherein the control system includes a a programmed pattern for selectively rotating the rotary gripping forks and the horngears.

19. The machine according to claim 18, wherein the programmed pattern includes a complex-shaped 3-D braided preform structure having at least two different cross-sectional shapes in the preform.

20. The machine according to claim 18, wherein the programmed pattern includes at least two different complex-shaped 3-D braided preform structures that are manufactured in continuous series.

21. The machine according to claim 18, wherein the programmed pattern includes 3-D braided preforms having cross sectional shapes selected from the group consisting of T, I, J, L, U, O, C, solid rectangle, open rectangle, solid circle, solid oval, open circle, open oval, semi-circle.

22. A method for producing complex shaped, three-dimensional engineered fiber preforms having a unitary, integral and seamless structure comprising the steps of:

providing a machine having a braiding mechanism for automatically manufacturing complex-shaped 3-D braided fiber preforms in continuous series, wherein the machine comprises a plurality of modules seamlessly connected adjacent to one another and having a gate design between adjacent modules comprising rotary gripping forks that match adjacent modules together and that function exactly as rotary gripping forks within each module for moving carrier drivers between adjacent modules, wherein each module comprises at least one module cell that is comprised of at least two homgears, at least two carrier drivers, and at least one rotary gripping fork, in mechanical connection to each other;

each horngear having a symmetrical horngear cell with complementary sections for carrying each of the carrier drivers;

each horngear connected to a horngear drive motor;

each rotary gripping fork having an independent drive;

each module cell having a compact configuration, which is defined by the symmetrical horngear cells matched with the carrier drivers to form a circular area, with a rotary gripping fork matched with and positioned in between the carrier drivers;

each of the at least two carrier drivers include a carrier with a yarn supply thereon; and a computer control system for operating the machine in a programmable, predetermined pattern of movement of the carrier drivers by the respective horngear and the rotary gripping fork;

said method further including the steps of:

performing an initial check-out of the machine to ensure that the carrier drives are aligned with the rotary gripping forks;

partially turning all horngears with yarn carriers for 45°;

activating a take up system;

turning select rotary gripping forks for confirming transfer of the carrier drivers from one horngear to adjacent homgears;

starting the machine;

operating the machine during a required time for making a predetermined preform shape and length, wherein operating the machine includes the steps of:

activating the plurality of modules; and selectively moving the carrier drivers individually and simultaneously across the modules by rotating the homgears and independently rotating the rotary gripping forks according to a programmed pattern.

23. The method according to claim 22, further including the step of: p1 activating modules selectively by the computer control system according to said programmed pattern to change the shape and dimensions of the preform being manufactured.

* * * * *